US009205479B2

(12) United States Patent
Erker

(10) Patent No.: US 9,205,479 B2
(45) Date of Patent: Dec. 8, 2015

(54) TRIANGULAR HEMMING AND STAMPING APPARATUS

(71) Applicant: Gerald Erker, Clarkston, MI (US)

(72) Inventor: Gerald Erker, Clarkston, MI (US)

(73) Assignee: Hirotec America, Inc., Auburn Hills, MI (US)

( * ) Notice: Subject to any disclaimer, the term of this patent is extended or adjusted under 35 U.S.C. 154(b) by 166 days.

(21) Appl. No.: 13/905,185

(22) Filed: May 30, 2013

(65) Prior Publication Data

US 2014/0352392 A1 Dec. 4, 2014

(51) Int. Cl.

| | |
|---|---|
| ***B21D 39/00*** | (2006.01) |
| ***B23P 11/00*** | (2006.01) |
| ***B21D 39/02*** | (2006.01) |
| ***B21D 37/10*** | (2006.01) |

(52) U.S. Cl.

CPC ..... *B21D 39/021* (2013.01); *B21D 37/10* (2013.01)

(58) Field of Classification Search

CPC ..... Y10T 29/53709; Y10T 29/49908; Y10T 29/49915; B21D 39/02; B21D 39/03; B21D 5/02; B21J 15/02

USPC ..... 29/243.5, 505, 509; 72/379.2

See application file for complete search history.

(56) References Cited

U.S. PATENT DOCUMENTS

| | | | | |
|---|---|---|---|---|
| 5,237,734 | A * | 8/1993 | Polon | 29/513 |
| 5,752,304 | A * | 5/1998 | Toeniskoetter | 29/243.58 |
| 6,154,942 | A * | 12/2000 | Toeniskoetter | 29/243.58 |
| 6,474,125 | B1 * | 11/2002 | Denis et al. | 72/306 |
| 6,640,601 | B2 * | 11/2003 | Hatty | 72/312 |
| 6,708,540 | B2 * | 3/2004 | Kawahara | 72/21.4 |
| 6,810,704 | B2 * | 11/2004 | Futamura et al. | 72/17.2 |
| 6,959,474 | B2 * | 11/2005 | Campian | 29/243.58 |
| 7,415,862 | B2 * | 8/2008 | Futamura et al. | 72/454 |
| 7,607,331 | B2 * | 10/2009 | Carsley et al. | 72/306 |
| 8,839,651 | B2 * | 9/2014 | Toeniskoetter | 72/312 |
| 2003/0192362 | A1 * | 10/2003 | Carsley et al. | 72/312 |
| 2012/0214015 | A1 * | 8/2012 | Carsley et al. | 428/582 |
| 2012/0270011 | A1 * | 10/2012 | Spencer | 428/124 |
| 2014/0352392 | A1 * | 12/2014 | Erker | 72/379.2 |

* cited by examiner

*Primary Examiner* — Paul D Kim

(74) *Attorney, Agent, or Firm* — Fildes & Outland, P.C.

(57) ABSTRACT

A triangular hemming and stamping apparatus includes a stationary base that mounts a lower die set. Three guide posts are triangularly positioned on the base and extend generally vertically from the base. An upper fixed superstructure is supported by the three guide posts and fixedly spaced from the base. An upper slidable structural member that mounts an upper die set is slidably mounted on the guide posts between the base and the superstructure. An actuator is mounted on the superstructure and connected to the upper slidable structural member within an area within the guide posts. The actuator is not connected to nor associated with the guide posts, and the actuator is operable to move the upper slidable structural member toward and away from the base to perform hemming and stamping on a workpiece.

16 Claims, 11 Drawing Sheets

TRIANGULAR HEMMING AND STAMPING APPARATUS

TECHNICAL FIELD

This invention relates to hemming of metal panels, and more particularly to vehicle closure panel production and hemming of vehicle closure panels.

BACKGROUND OF THE INVENTION

It is known in the art relating to hemming and stamping that conventional hemming and stamping presses include a lower structural member supported by the floor or foundation with columns mounted to the lower structural member and extending vertically upwards to support an upper fixed structural member. The upper fixed structural member supports an actuation apparatus which may include a hydraulic cylinder(s), electric crank type actuator or other drive type mechanisms. An upper slidable structural member or ram is slidably mounted between the lower structural member and upper fixed structural member on a guidance system which may include a single or multiplicity of guide shafts, gibs and wear plates, or rolling type guides. Furthermore, a removable die set that consists of a lower die and upper die are supported by the lower structural member and upper slidable structural member/ram. The lower die set is fixedly mounted to the lower structural member whereas the upper die is fixedly mounted to the upper slidable structural member/ram. This type of mounting method normally forces the press structure to be greater in size than needed for the die set, causing the press structure to cost more than required for a certain product.

Conventional hemming and stamping presses impose difficulties and obstructions during general maintenance and repairs on die sets. Die sets that are placed in a conventional press are usually surrounded on two sides by columns that are vertical members that mount to the lower structural member and support the upper fixed structural member of a press. Maintenance and/or repair performed in these obstructed areas of the die sets can be cumbersome and dangerous due to worker being inside the press during the repair. Another option for maintenance and repair in these obstructed areas is to remove the die set from the press structure. This in itself can add to the down time of a production run and impose an additional cost of operation. Removal of a die set from a press normally requires the use of additional equipment such as a frame work on which to roll and support the die set, or a die cart or lift truck capable of supporting the weight of the die set. Furthermore, conventional moderately sized to larger sized hemming/stamping equipment or presses require disassembly due to their inherent excessive physical size or weight during transportation and then reassembly at their final destination or area that at which they will be operated.

Conventional hemming and stamping presses are also known to be square or rectangular in shape as viewed from above in plan view, which necessitates greater spacing between the products being hemmed or stamped. This is due to the product workpiece normally being much smaller than the press that is performing the hemming/stamping operation as well as the shape of the structure. The columns of a hemming and stamping press normally are on the sides perpendicular to the load/unload side. With the columns of the hemming and stamping press perpendicular to the load/unload side, a second hemming press must be spaced away from the first hemming press by a centerline distance that is half the product width plus the distance between the edge of the product and the clearance to the inside of the column plus the column width and a clearance value between the two hemming presses. As shown in FIG. 7, a known process for a hemming system with four products is to have two hemming presses spaced apart and in line with each other. A second set of two hemming presses are spaced opposite the first two hemming presses to create four presses spaced apart with their load/unload sides facing opposite each other. A material handling robotic arm is positioned centrally between all four opposing hemming presses. The material handling robot is normally mounted to a slidable transfer unit to enable the material handling robot to reach all four products in the hemming presses. A marriage/load stand is spaced centrally between the two opposing leading hemming presses and an unload stand is spaced centrally between the two opposing trailing hemming presses.

SUMMARY OF THE INVENTION

The present invention provides an apparatus and method for hemming and stamping in which the die sets are integral with the upper slidable and lower structural members. The present hemming and stamping apparatus also includes triangularly positioned guide posts that are positioned in optimal locations around the central force vector. The hemming and stamping apparatus thereby allows for minimization of the overall perimeter of the die sets, optimization of the strength and cost of the die sets based on product features and size, stabilization of unbalanced loads in the die sets, reduction in structure size and footprint, and increased accessibility of the internal die components in the press structure. Additionally, the present invention utilizes removable locking devices that when removed allow the upper superstructure and actuator to be lowered onto the platen/ram in an at-rest position in which they are set on the lower structural member.

More particularly, a triangular hemming and stamping apparatus in accordance with the present invention includes a stationary base that mounts a lower die set. Three guide posts are triangularly positioned on the base and extend generally vertically from the base. An upper fixed superstructure is supported by the three guide posts and fixedly spaced from the base during operation. This upper superstructure becomes slidably moveable on the three guide posts to aid in transportation and installation. An upper slidable structural member that mounts an upper die set is slidably mounted on the guide posts between the base and the superstructure. An actuator is mounted on the superstructure and connected to the upper slidable structural member within an area within the guide posts. The actuator is not connected to or associated with the guide posts, and the actuator is operable to move the upper slidable structural member toward and away from the base to perform hemming and stamping on a workpiece. This actuator is also used to actuate the upper superstructure to place it in a transportation/installation position.

In a specific embodiment, within an area within said guide posts, the actuator may be generally disposed at the centroid of a triangle defined by the guide posts. The guide posts also may be positioned in optimal locations around the central force vector of said actuator. Internal die set components may be fixedly mounted directly to the base, and internal die set components may be fixedly mounted directly to the upper slidable structural member. The upper and lower die sets are accessible from each side of the apparatus. The actuator may be a hydraulic or electric drive mechanism.

A robotic hemming cell for hemming and stamping a workpiece in accordance with the present invention includes a centrally disposed material handling robot and a plurality of hemming and stamping apparatus radially disposed around the material handling robot. Each hemming and stamping apparatus includes a stationary base that mounts a lower die set. Three guide posts are triangularly positioned on the base and extend generally vertically from the base. An upper fixed superstructure is supported by the three guide posts and fixedly spaced from the base. An upper slidable structural member that mounts an upper die set is slidably mounted on the guide posts between the base and the superstructure. An actuator is mounted on the superstructure and connected to the upper slidable structural member within an area within the guide posts. The actuator is not connected to or associated with the guide posts, and the actuator is operable to move the upper slidable structural member toward and away from the base to perform hemming and stamping on a workpiece.

The cell may further include a workpiece loading station disposed between two of the integrated hemming and stamping apparatus. The cell may also include a workpiece unloading station disposed between two of the integrated hemming and stamping apparatus. The workpiece loading station may be disposed opposite said workpiece unloading station. The material handling robot may be rotatably mounted to a fixed base. The material handling robot may be a multi-axis robotic arm. Within an area within the guide posts of each of hemming and stamping apparatus, the actuator may be generally disposed at the centroid of a triangle defined by the guide posts.

A method of hemming and stamping includes the steps of: mounting a lower die set on a base; triangularly positioning three guide posts on the base, the three guide posts extending generally vertically from the base; supporting an upper fixed superstructure on the three guide posts, the upper fixed superstructure being fixedly spaced from the base; slidably mounting an upper slidable structural member on the guide posts between the base and the upper fixed superstructure, the upper slidable structural member mounting an upper die set; and mounting an actuator on the upper fixed superstructure, wherein the actuator is not connected to nor associated with the guide posts, and the actuator is operable to move the upper slidable structural member toward and away from the base to perform hemming and stamping on a workpiece.

In addition, a method of erecting and maintaining the triangular hemming and stamping apparatus is performed by positioning the platen in a fully lowered position resting on the lower die set by use of the platen actuator, removing the locking nuts on the tops of the guide posts, extending the actuator to relieve the upper superstructure from the locking plates, removing the locking plates from the upper superstructure, and retracting the actuator which in turn lowers the upper superstructure until the die sets come in contact with each other in the lowered position. This method of mounting a fixed superstructure using a slideable connection allows for easier maintenance and installation at a reduced height, as well as easier transportation. The reduced height also broadens the range of placement locations of the hemming and stamping apparatus in a manufacturing facility.

These and other features and advantages of the invention will be more fully understood from the following detailed description of the invention taken together with the accompanying drawings.

DETAILED DESCRIPTION OF THE INVENTION

Figure 1:
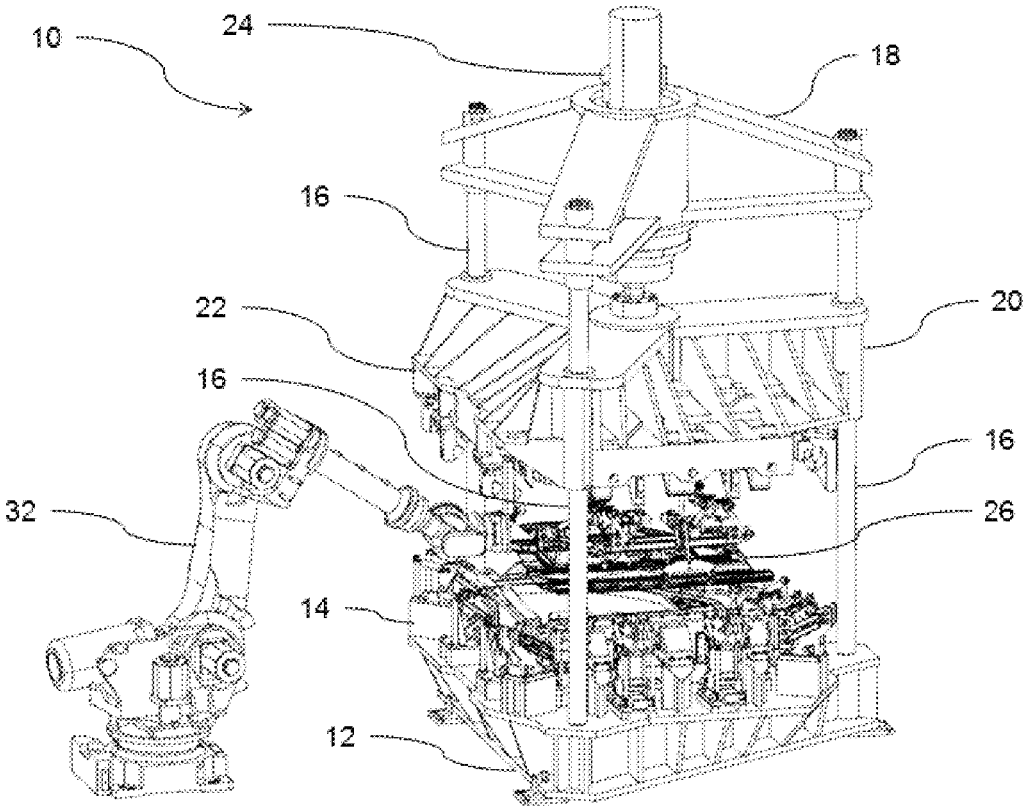
FIG. 1 is a perspective view of a triangular hemming and stamping apparatus having an integrated die set in accordance with the present invention.
Figure 2:
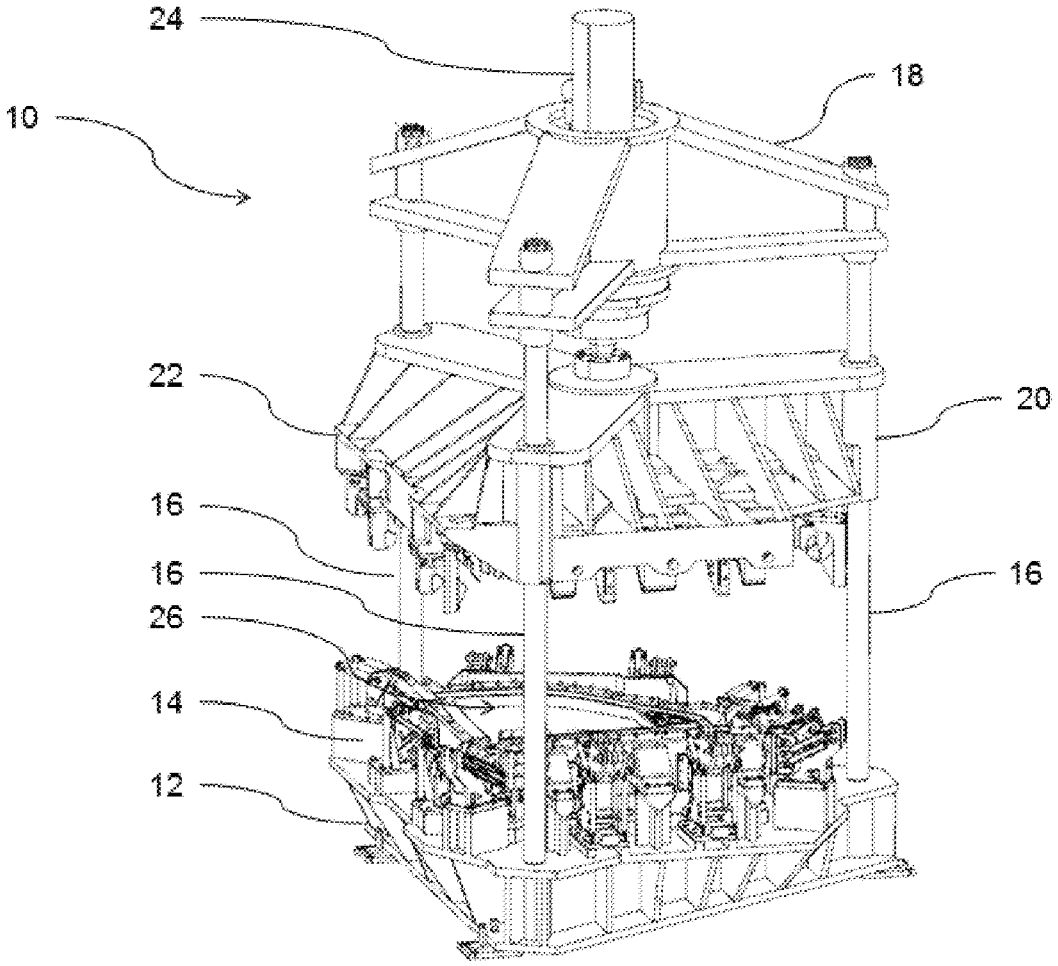
FIG. 2 is a perspective view of the hemming and stamping apparatus in an open position.
Figure 3:
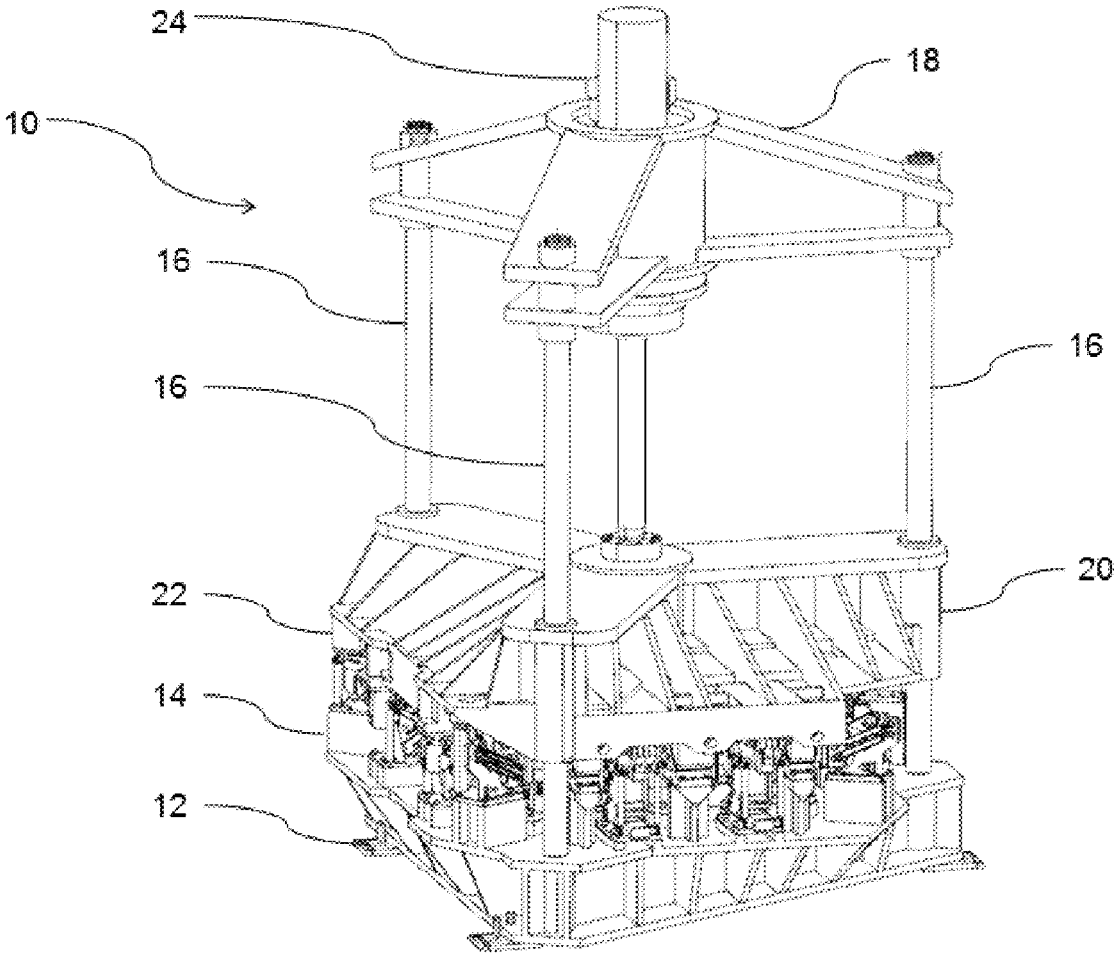
FIG. 3 is a perspective view of the hemming and stamping apparatus in a closed position.
Figure 4:
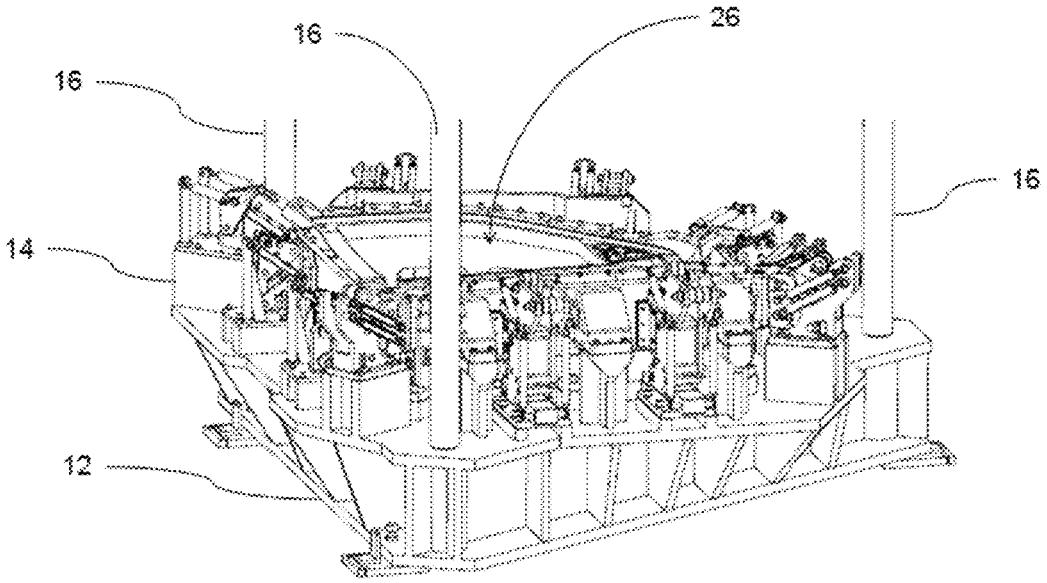
FIG. 4 is an enlarged view of a stationary lower structural member of the hemming and stamping apparatus.
Figure 5:
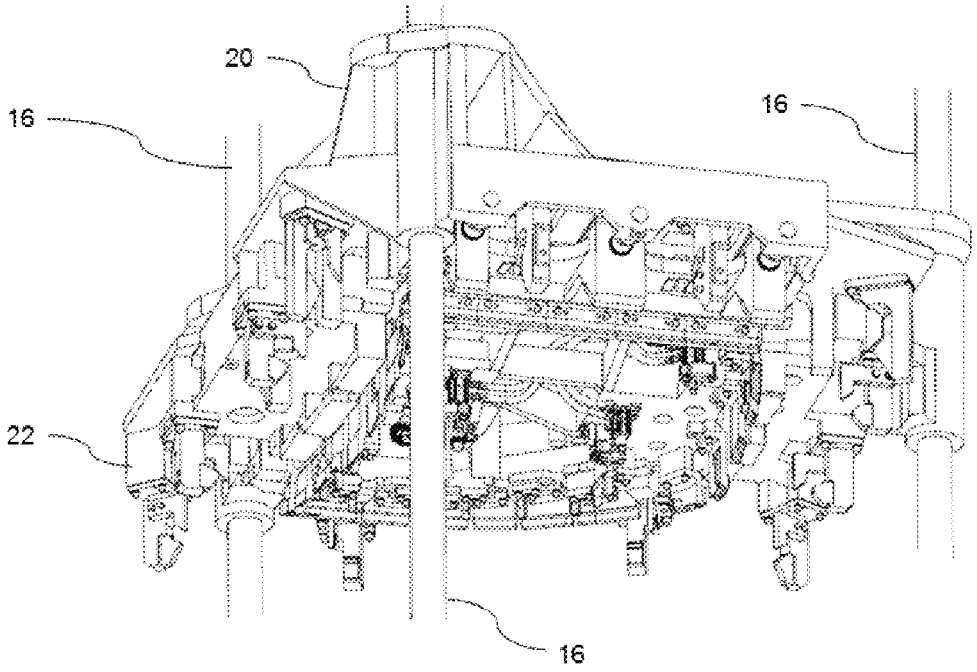
FIG. 5 is an enlarged view of a slidable upper structural member of the hemming and stamping apparatus.

Referring now to the drawings in detail, numeral 10 generally indicates a triangular hemming and stamping apparatus in accordance with the present invention. The guide posts of the hemming and stamping apparatus 10 are thereby optimally positioned to minimize the footprint of the apparatus, to increase the strength of the apparatus, and to improve access to the die sets mounted in the apparatus for maintenance and repair. The triangular positioning of the guide posts of the apparatus 10 also provide for optimal staging of a plurality of the apparatus 10 in a robotic work cell.

With reference to FIGS. 1 through 5, the triangular hemming and stamping apparatus 10 includes a stationary base 12 that directly and fixedly mounts a lower die set 14 including die set components. The base is generally supported by a floor, such as the floor of a work cell. Three guide posts 16 are triangularly positioned on the base 12 and extend generally vertically from the base. An upper fixed superstructure 18 is supported by the three guide posts and fixedly spaced from the base 12. An upper slidable structural member 20 is slidably mounted on the guide posts 16 between the base 12 and the superstructure 18. The upper slidable structural member 20 directly and fixedly mounts an upper die set including die set components. The lower and upper die sets 14, 22 may be cast or fabricated structures.

An actuator 24, such as a hydraulic, electric, or similar drive mechanism, is mounted on the superstructure 18 and connected to the upper slidable structural member 20 within an area within the guide posts 16. The actuator 24 is not connected to or associated with the guide posts 16, and the actuator is operable to move the upper slidable structural member 20 toward and away from the base 12 to perform hemming and stamping on a workpiece 26. In contrast, in a conventional press apparatus, the actuator(s) is mounted on or associated with the guide posts. The actuator 24 is generally centered between the guide posts 16. For example, within an area within a perimeter of the guide posts 16, the actuator 24 may be generally disposed at the centroid of a triangle defined by straight lines connecting adjacent guide posts. The centroid is the intersection of the three medians (straight lines through a vertex and the midpoint of the opposite side) of the triangle. The guide posts 16 also may be positioned in optimal locations around the central force vector of the actuator 24, to minimize the overall perimeter of the die sets and to stabilize unbalanced loads in the die set. Since three points are the least number of points to create a plane, the three guide shaft bearing points on the guide posts 16 have both the least sliding resistance and greatest stability over a group of four or more guide shafts in a similar mounting arrangement.

The triangular positioning of the guide posts 16 optimizes and reduces size of the apparatus 10 because of reduced span between vertical supports (three guide posts can be positioned closer together than multiples greater than three, thus reducing the distance between them.) Due to the triangular positioning of the guide posts 16, the upper and lower die sets 14, 22 are accessible from each side of the apparatus, such as by a material handling robot 32. In contrast, in a conventional press apparatus, the guide posts are typically disposed on two opposing sides of the die sets, only allowing access from the front or back of the press and not from the sides during maintenance or service.

The die sets 14, 22 are product specific and may be in the form of hemming die sets, stamping die sets or various other types of die sets. The integral die sets 14, 22 allow the apparatus 10 to be manufactured to a minimum (optimum) size based on the specific product workpiece 26 that will be processed by the apparatus. The product workpiece 26 and process being completed on the workpiece dictates the required tonnage needed to complete the hemming, stamping or other operation on it, and output force (tonnage capacity) of the apparatus 10 can be selected based on product features and size, which in turn dictates the size and strength requirements of the members of the apparatus. By having integrated die sets 14, 22, the structural members of the apparatus 10 can be manufactured to accept the required force needed for the specific operation. This allows each apparatus 10 (press/hemmer/stamper or other) according to the invention to be sized correspondingly to the specific product workpiece 26 that will be staged in it, and allows the structural members of the apparatus to be optimized for strength and cost based on product workpiece features and size. For example, the diameter of the guide posts 16 are sized by tonnage output and span of structure to allow for reduced cost. Thus, the apparatus 10 is not a one-size-fits-all structure, but instead is sized to fit specific applications. In turn, the actuator 24 that moves the upper slidable structural member 20 can be optimized per the required force needed to complete the operation on the product workpiece 26. Allowing the apparatus 10 to be manufactured to the product workpiece 26 requirements drastically reduces the manufacturing cost by optimizing the die components of the apparatus per the product.

Figure 6:
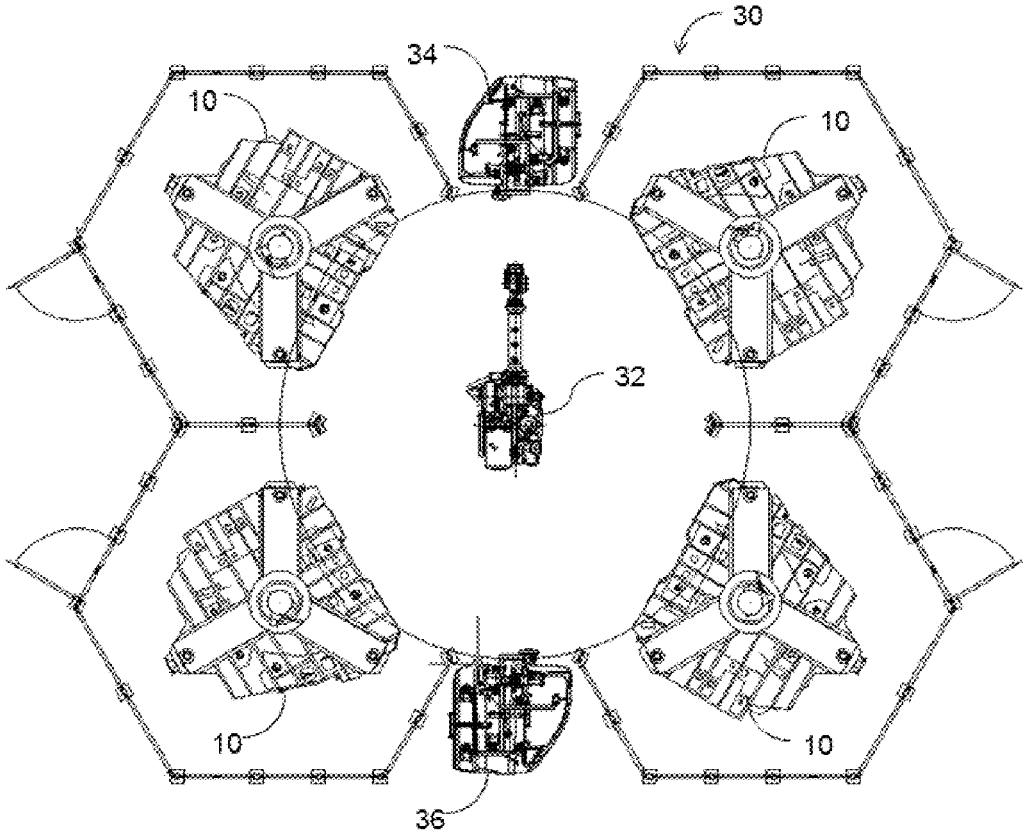
FIG. 6 is a plan view of a robotic hemming cell in accordance with the present invention including a plurality of triangular hemming and stamping apparatus radially disposed around a material handling robot.

Turning to FIG. 6, a robotic hemming cell 30 in accordance with the invention includes a centrally disposed material handling robot 32 and a plurality of hemming and stamping apparatus 10 radially disposed around the material handling robot. The triangulated structure of the apparatus 10 allows the apparatus 10 to be disposed radially about the central material handling robot 32. The material handling robot 32 may be a multi-axis robotic arm or similar robotic device capable of manipulating workpieces. The material handling robot 32 also may be rotatably mounted to a fixed base. Each apparatus 10 may be product specific whereby up to four different products may be passed through the cell 30 for hemming and/or stamping.

A workpiece loading station 34 is disposed between two of the integrated hemming and stamping apparatus 10, and a workpiece unloading station 36 is disposed between another two of the integrated hemming and stamping apparatus 10. For example, the cell 30 may include four hemming and stamping apparatus 10, the workpiece loading station 34 may be disposed between a pair of the apparatus 10, the workpiece unloading station 36 may be disposed between the other pair of apparatus 10, and the workpiece loading station 34 may be disposed opposite the workpiece unloading station 36. The workpiece loading station 34 holds workpieces that are fed into the cell 30 for the material handling robot 32 to pick up and deliver to one of the hemming and stamping apparatus 10. The workpiece unloading station 36 holds finished workpieces that the material handling robot 32 has removed from one of the hemming and stamping apparatus 10 for removal from the cell 30.

Figure 7:
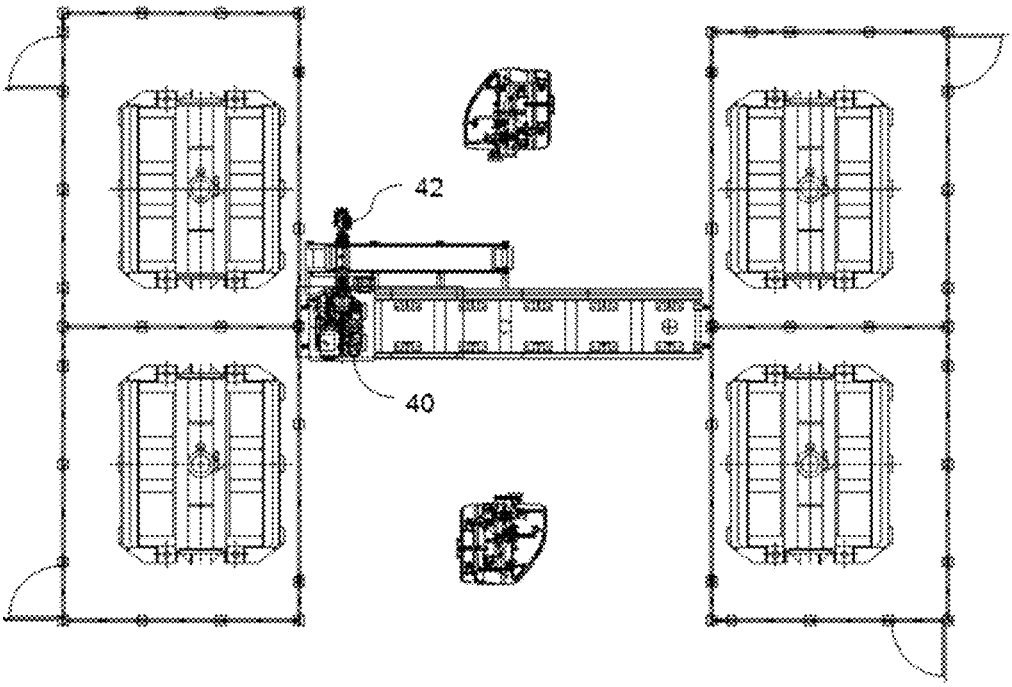
Fig. 7 Prior Art
FIG. 7 is a plan view of a conventional robotic hemming cell.

The radial staging of multiple hemming and stamping apparatus 10 eliminates the use of a slidable transfer unit 40 for slidably moving the material handling robot 42 such as shown in the prior art of FIG. 7. Further, the close proximity of the apparatus 10 in the present cell 30 allows for a greater than a one-third reduction of floor space usage over a conventional staging method as shown in the prior art. For example, the four-product robotic hemming cell 30 may utilize approximately 832 square feet of floor space, while a conventional four-product robotic hemming cell may require approximately 1320 square feet.

Figure 8:
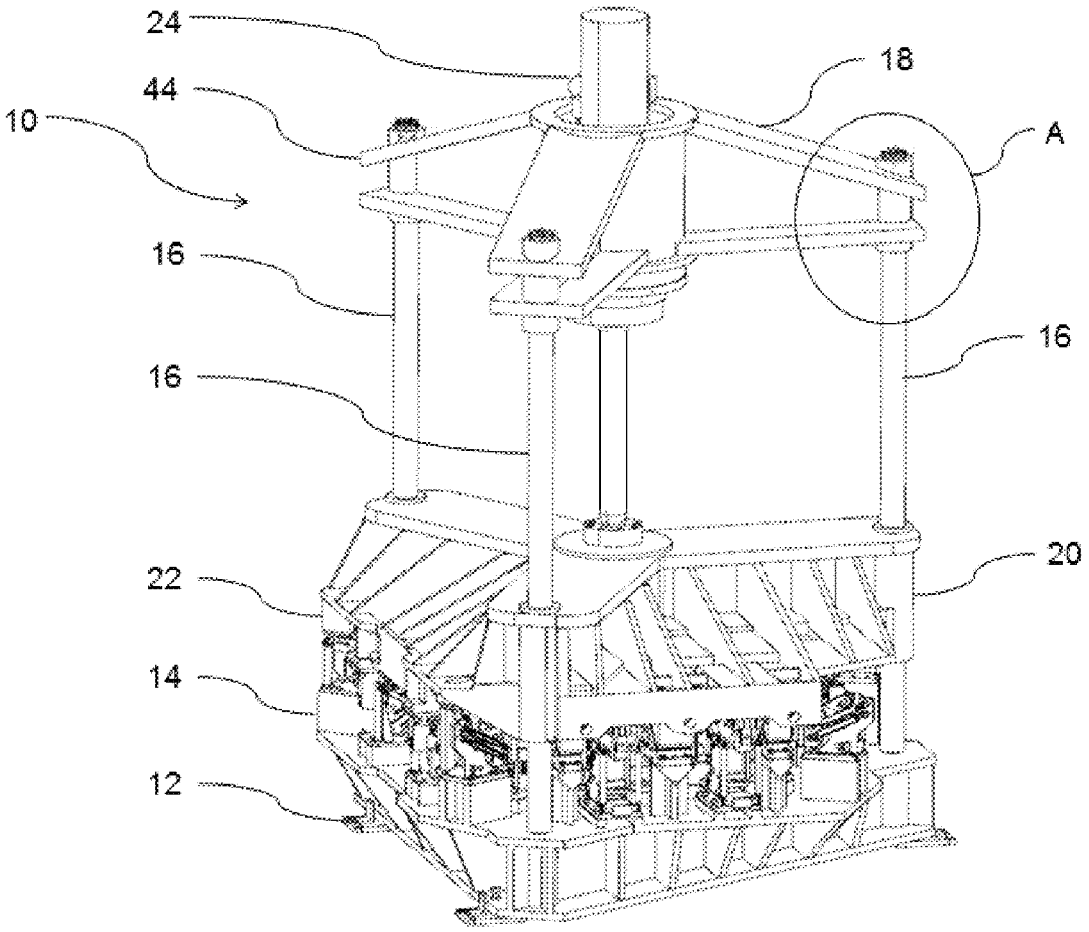
FIG. 8 is another perspective view of the hemming and stamping apparatus in a closed position.
Figure 9:
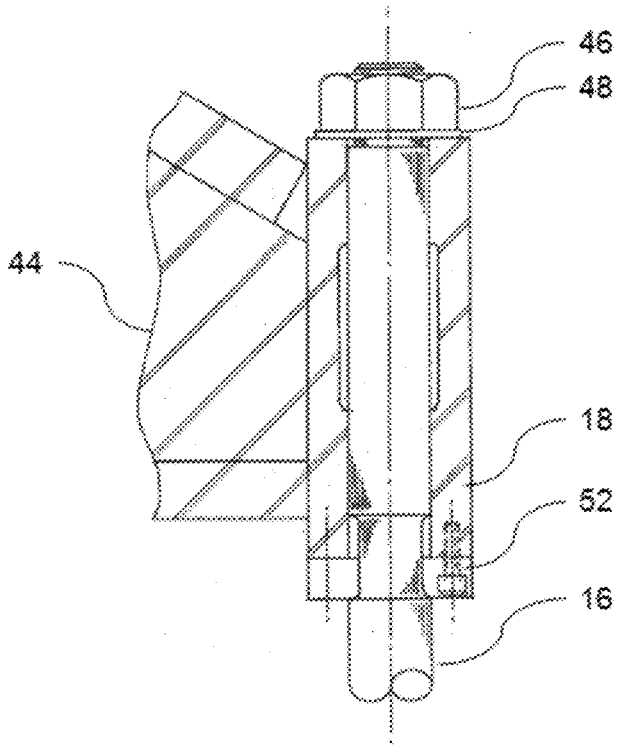
FIG. 9 is an enlarged sectional view of an upper superstructure member to guide post interface of the hemming and stamping apparatus.
Figure 10:
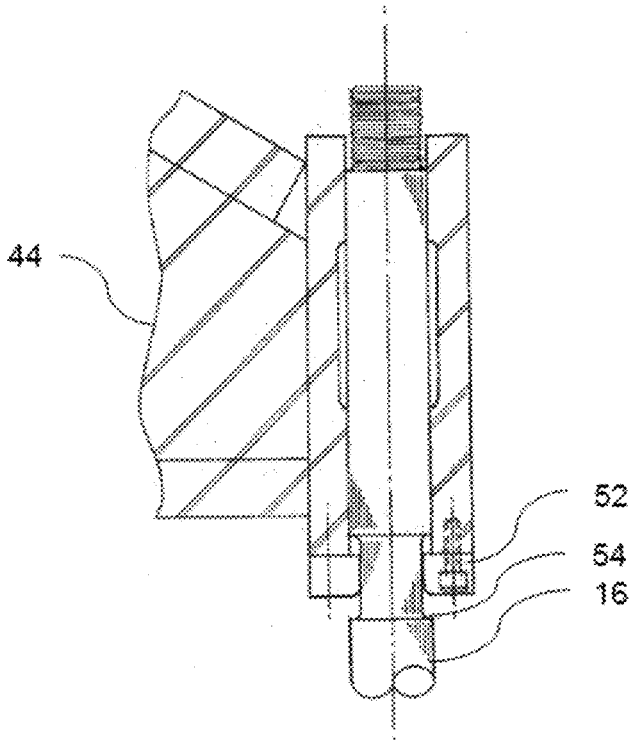
FIG. 10 is another enlarged sectional view of the upper superstructure member to guide post interface of the hemming and stamping apparatus.
Figure 11:
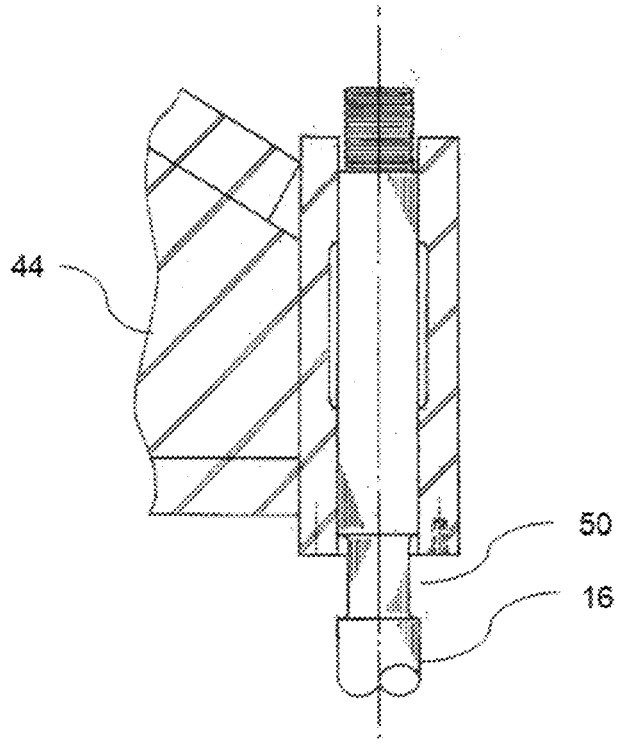
FIG. 11 is another enlarged sectional view of the upper superstructure member to guide post interface of the hemming and stamping apparatus.
Figure 12:
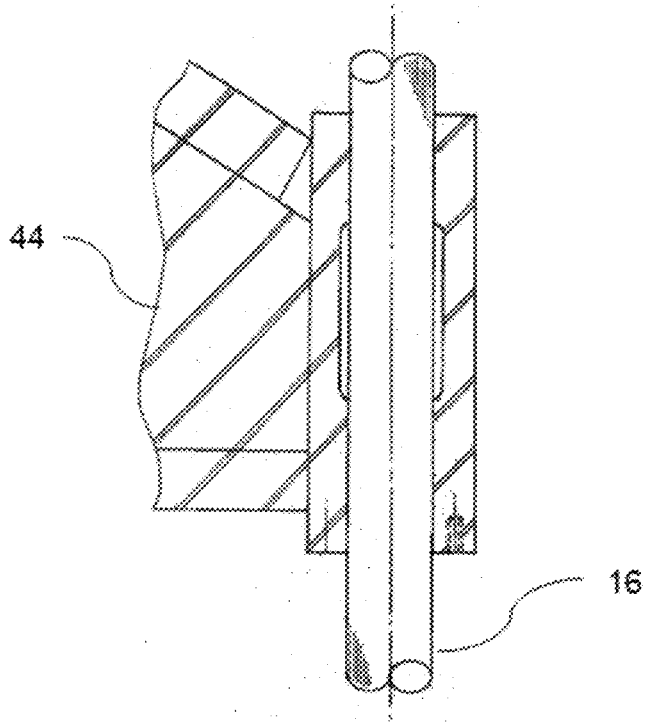
FIG. 12 is yet another enlarged sectional view of the alternative upper superstructure member to guide post interface of the hemming and stamping apparatus.
Figure 13:
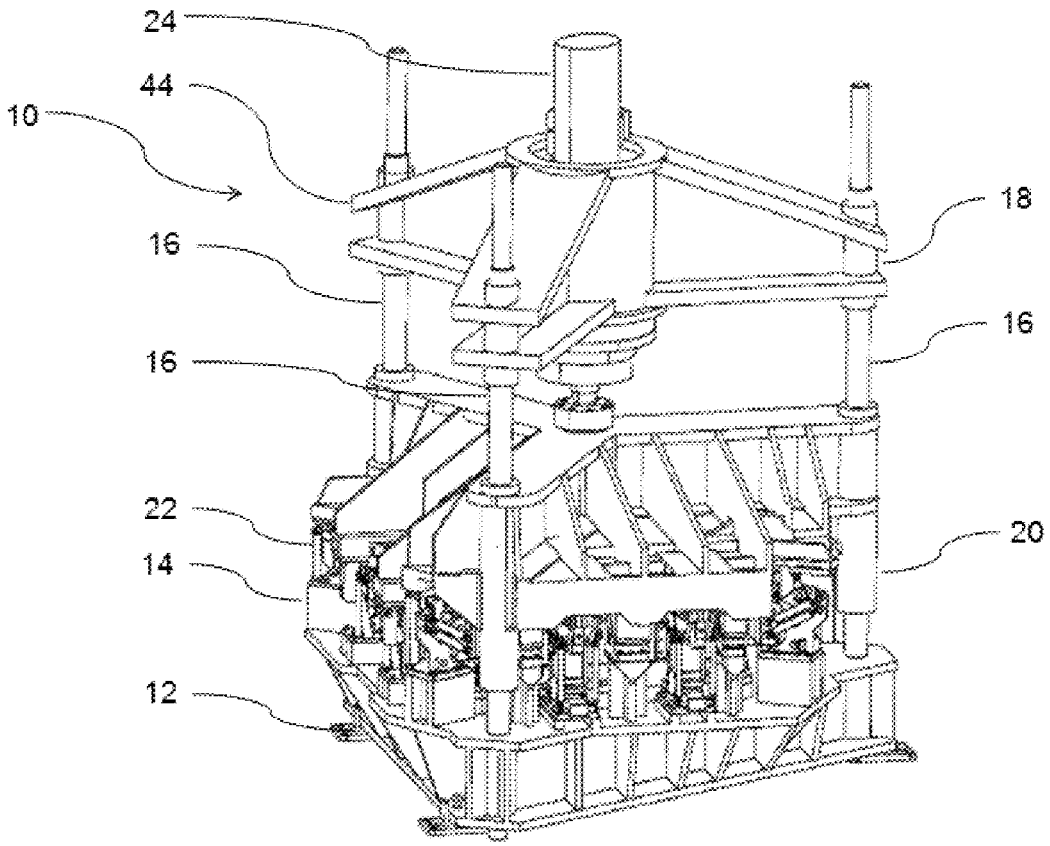
FIG. 13 is a perspective view of the hemming and stamping apparatus in a closed position with the upper superstructure in the lowered position.

With reference to FIG. 8, the upper superstructure 18 of the triangular hemming and stamping apparatus 10 is fastened to the guide posts 16 in a manner that allows the superstructure/actuator assembly 44 to be slidably lowered on the guide posts 16. An enlarged portion A of the superstructure/actuator assembly is illustrated in FIGS. 9 through 12. Slidably lowering the upper superstructure 44 allows the overall height of the hemming and stamping apparatus 10 to be reduced. Consequently, the reduced height of the hemming and stamping apparatus 10 allows it to be transported as a regular load on a flatbed type semi-trailer. The slidably lower-able superstructure/actuator assembly 44 also improves overhead clearance when maintaining or replacing the actuator 24. It is known that low overhead obstructions are typically present in a facility in which the apparatus 10 is used; the benefits of the reduced height allows greater freedom of placement within such a facility. A method of slidably lowering the upper superstructure/actuator assembly 44 includes extending the actuator 24 to lower the upper slidable structural member 20 until the die sets 14 and 22 contact each other as shown in FIG. 8. The upper tensioning nut 46 and washer 48 shown in FIG. 9 are then removed from the guide posts 16. The actuator 24 is extended to slidably raise the upper superstructure/actuator assembly 44, separating the locking plate 52 from the heel surface 54 on the guide posts 16 as shown in FIG. 10. The locking plate 52 is then removed from the upper superstructure 18, exposing the undercut 50 on the guide posts 16 as shown in FIG. 11. FIGS. 12 and 13—Finally, the actuator 24 is retracted as shown in FIG. 12 to allow the upper superstructure/actuator assembly 44 to be slidably lowered until the actuator 24 reaches the end of its useable stroke. The lowered position of the upper superstructure/actuator assembly 44 is illustrated in FIG. 13.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A hemming and stamping apparatus comprising:

a stationary base;

a lower die set mounted on said stationary base;

three and only three guide posts triangularly positioned on said base and extending generally vertically from said base;

an upper fixed superstructure supported by said three guide posts and fixedly spaced from said base;

an upper slidable structural member, said upper slidable structural member being slidably mounted on said guide posts between said base and said superstructure;

an upper die set mounted on said upper slidable structural member; and an actuator mounted on said superstructure and directly connected to said upper slidable structural member within a perimeter defined by said guide posts, wherein said actuator is not directly connected to said guide posts, said actuator is not mechanically linked to said guide posts, and said actuator is configured to move said upper slidable structural member toward and away from said base to perform hemming and stamping on a workpiece.

2. The apparatus of claim 1, wherein, within the perimeter defined by said guide posts, said actuator is generally disposed at the centroid of a triangle defined by said guide posts.

3. The apparatus of claim 1, wherein said guide posts are positioned around the central force vector of said actuator to minimize the perimeter defined by said guide posts and to stabilize unbalanced loads in the die sets.

4. The apparatus of claim 1, wherein internal die set components are fixedly mounted directly to said base.

5. The apparatus of claim 1, wherein internal die set components are fixedly mounted directly to said upper slidable structural member.

6. The apparatus of claim 1, wherein said upper and lower die sets are accessible from each side of the apparatus.

7. The apparatus of claim 1, wherein said actuator is one of a hydraulic and electric drive mechanism.

8. A robotic hemming cell for hemming and stamping a workpiece, said robotic hemming cell comprising:

a centrally disposed material handling robot;

a plurality of hemming and stamping apparatus radially disposed around said material handling robot;

each said hemming and stamping apparatus including:

a stationary base;

a lower die set mounted on said stationary base;

three and only three guide posts triangularly positioned on said base and extending generally vertically from said base;

an upper fixed superstructure supported by said three guide posts and fixedly spaced from said base;

an upper slidable structural member, said upper slidable structural member being slidably mounted on said guide posts between said base and said superstructure;

an upper die set mounted on said upper slidable structural member; and an actuator mounted on said superstructure and directly connected to said upper slidable structural member within a perimeter defined by said guide posts, wherein said actuator is not directly connected to said guide posts, said actuator is not mechanically linked to said guide posts, and said actuator is configured to move said upper slidable structural member toward and away from said base to perform hemming and stamping on a workpiece.

9. The cell of claim 8, including a workpiece loading station disposed between two said integrated hemming and stamping apparatus.

10. The cell of claim 8, including a workpiece unloading station disposed between two said integrated hemming and stamping apparatus.

11. The cell of claim 10, including a workpiece loading station disposed between two said integrated hemming and stamping apparatus, wherein said workpiece loading station is disposed opposite said workpiece unloading station.

12. The cell of claim 8, wherein said material handling robot is rotatably mounted to a fixed base.

13. The cell of claim 8, wherein said material handling robot is a multi-axis robotic arm.

14. The cell of claim 8, wherein, within the perimeter defined by said guide posts, said actuator is generally disposed at the centroid of a triangle defined by said guide posts.

15. A method of hemming and stamping comprising the steps of:

mounting a lower die set on a base;

triangularly positioning three and only three guide posts on said base, said three guide posts extending generally vertically from said base;

supporting an upper fixed superstructure on said three guide posts, said upper fixed superstructure being fixedly spaced from said base;

slidably mounting an upper slidable structural member on said guide posts between said base and said upper fixed superstructure;

mounting an upper die set on said upper slidable structural member;

mounting an actuator on said upper fixed superstructure and directly connecting said actuator to said upper slidable structural member within a perimeter defined by said guide posts, wherein said actuator is not directly connected to said guide posts, said actuator is not mechanically linked to said guide posts, and said actuator is configured to move said upper slidable structural member toward and away from said base to perform hemming and stamping on a workpiece.

16. The method of claim 15, including the steps of:

extending said actuator to lower said upper slidable structural member until said upper and lower die sets contact each other;

removing an upper tensioning nut and washer from each of said guide posts;

further extending said actuator to slidably raise said upper fixed superstructure and said actuator, and to separate a locking plate from a heel surface of each of said guide posts;

removing said locking plate from a heel surface of each said guide posts; and retracting said actuator to allow said upper fixed superstructure and said actuator to be slidably lowered.

* * * * *